US005613747A

United States Patent [19]

Becker et al.

[11] Patent Number: 5,613,747

[45] Date of Patent: Mar. 25, 1997

[54] TOEPLATE AND ACCESS COVER

[75] Inventors: Craig H. Becker, Fond-Du-Lac, Wis.; Bradley B. Hobday, Goldsboro; Jim Fourney, LaGrange, both of N.C.

[73] Assignee: White Consolidated Industries, Inc., Cleveland, Ohio

[21] Appl. No.: 602,499

[22] Filed: Feb. 20, 1996

[51] Int. Cl.[6] ..... A47B 97/00

[52] U.S. Cl. ..... 312/278; 312/228; 312/311

[58] Field of Search ..... 312/236, 278, 312/204, 228, 311, 293.1, 293.3, 323, 265.6, 351.11; 126/191, 194, 547

[56] References Cited

U.S. PATENT DOCUMENTS

| | | | |
|---|---|---|---|
| 3,738,727 | 6/1973 | Race et al. | 312/311 X |
| 3,905,663 | 9/1975 | Bergeson . | |
| 4,128,287 | 12/1978 | Loch et al. | 312/278 X |
| 4,290,660 | 9/1981 | Brezosky . | |
| 4,295,692 | 10/1981 | Jenkins | 312/228 |
| 4,390,006 | 6/1983 | Kowk | 312/311 |
| 4,674,806 | 6/1987 | Kroon et al. . | |
| 4,865,366 | 9/1987 | Kretchman . | |
| 4,932,224 | 6/1990 | Katterhenry et al. | 312/236 |
| 5,158,346 | 10/1992 | Marks et al. | 312/204 |
| 5,230,553 | 7/1993 | Tuller | 312/228 |
| 5,299,586 | 4/1994 | Jordan et al. . | |

FOREIGN PATENT DOCUMENTS

| | | | |
|---|---|---|---|
| 2016637 | 10/1971 | Germany | 312/228 |

*Primary Examiner*—Peter M. Cuomo
*Assistant Examiner*—James O. Hansen
*Attorney, Agent, or Firm*—Pearne, Gordon, McCoy & Granger

[57] ABSTRACT

The toespace below the door of a front-loading dishwasher is closed off from the under-tub space inside the dishwasher assembly by a combined toeplate-and-access-panel member which also closes off the door-bottom-receiving recess above the toespace; in installed condition, the combined member is anchored at its top edge by cooperating projecting and receptor elements associated respectively with the tub bottom and the top edge of the combined member.

9 Claims, 2 Drawing Sheets

TOEPLATE AND ACCESS COVER

This invention relates to dishwashers, particularly to those that are front-loading and have a door at the front which gives access to the washer tub, is hinged near its lower edge, and is spaced above the floor or other mounting surface.

BACKGROUND OF THE INVENTION

In dishwashers of the foregoing type, the washer tub is also spaced and supported above the mounting surface by metal frame members, and an under-tub space is defined by such spacing. The fronts of such dishwashers are generally arranged to provide a toespace extending upward for several centimeters above floor level and rearward for several centimeters behind the main front plane of the dishwasher. A toespace improves the aesthetics of the washer and contributes to the comfort of users or other persons when loading or unloading dishes or working on the counter under which the dishwasher is located. The rearward limit of the toespace is defined by a generally vertical toeplate extending across the width of the dishwasher so as to engage the toe of a user's shoe and thereby prevent the user from inadvertently stepping inward and damaging any element located immediately behind the toespace.

It is also known to provide the fronts of such dishwashers with a recess space above the toespace and behind the bottom part of the door, that is, behind the part of the door that hinges in the backward direction as the door is opened. The recess accommodates the bottom of the door as it moves rearward and upward during opening. The under-tub space is closed off at the upper region of this recess space by an access plate or panel. This access panel may be an upper extension of the toe plate.

The upper regions of the recess space are difficult to reach whether the door is open or closed. In the open position of the door, the bottom of the door occupies such upper regions of the recess space, and the forwardly projecting main part of the door further interferes with access to such regions. In the closed position of the door, the recess space is up behind the bottom of the door, and its upper regions are difficult to reach because the door bottom is in the way. In either case, installation of threaded fasteners for affixing the upper part of the toeplate is difficult and time-consuming because of the difficulty of accessing such upper regions of the recess space with screwdrivers or other tools for tightening (or loosening) the fasteners.

BRIEF DESCRIPTION OF THE INVENTION

In the present invention, the need for accessing the upper regions of the recess space with screwdrivers or the like is dispensed with. The only threaded fasteners employed to mount the toeplate are in readily accessible position at or near the bottom of the toeplate and well below the closed (or lowermost) position of the bottom edge of the door.

The invention involves providing downward projections fixed to the bottom of the tub and aligned transverse to the tub and generally parallel to the hinge line of the door, and providing cooperating receptors associated with the upper edge of a combined toeplate-and-access-panel member. This latter member is of the type comprising a lower forward panel and a upper rearward panel each of which is relatively vertical, and a middle panel which is relatively horizontal and joins the upper and lower panels. The upper edge of the combined member can be readily positioned up at the top rear of the recess space, to thereby position the receptors over the downward projections, by manipulation of the combined member while grasping the lower edge of its lower panel. The lower edge continues to be readily accessible and easily grasped from the front exterior of the dishwasher at all times during such manipulation, and thereafter is easily affixed to the metal frame by a pair of threaded fasteners associated with the lower edge of the lower panel and preferably located adjacent that edge when in place. The combined member can be hinged into place and supported there prior to placing and tightening of the fasteners, as more fully described below.

DESCRIPTION OF THE PREFERRED EMBODIMENT

Figure 1:
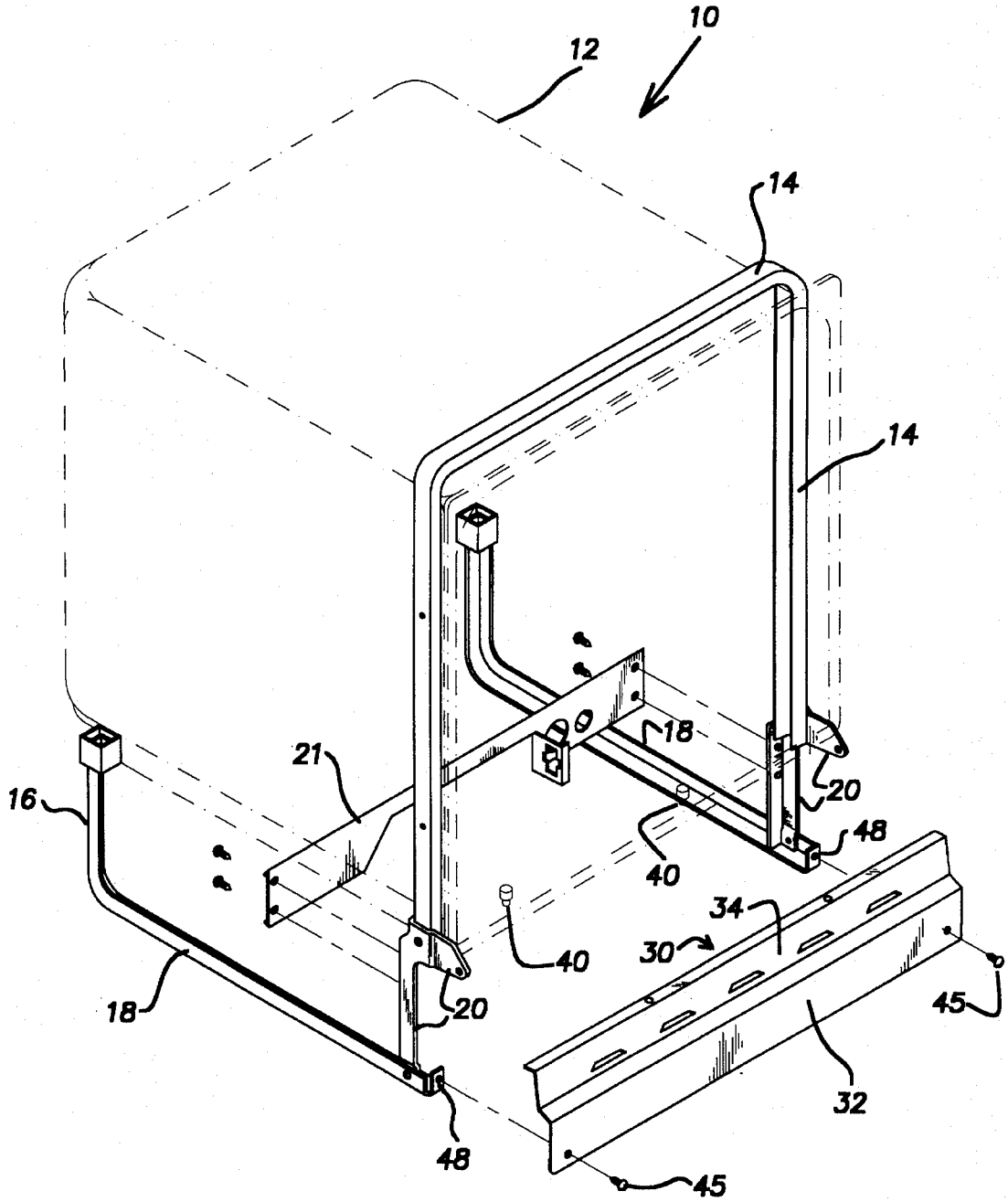
FIG. 1 is a partly exploded isometric view of frame or supporting members of a dishwasher, and also showing the washer tub in phantom, and further showing a combined toeplate-and-access-panel member usable with the assembly.
Figure 2:
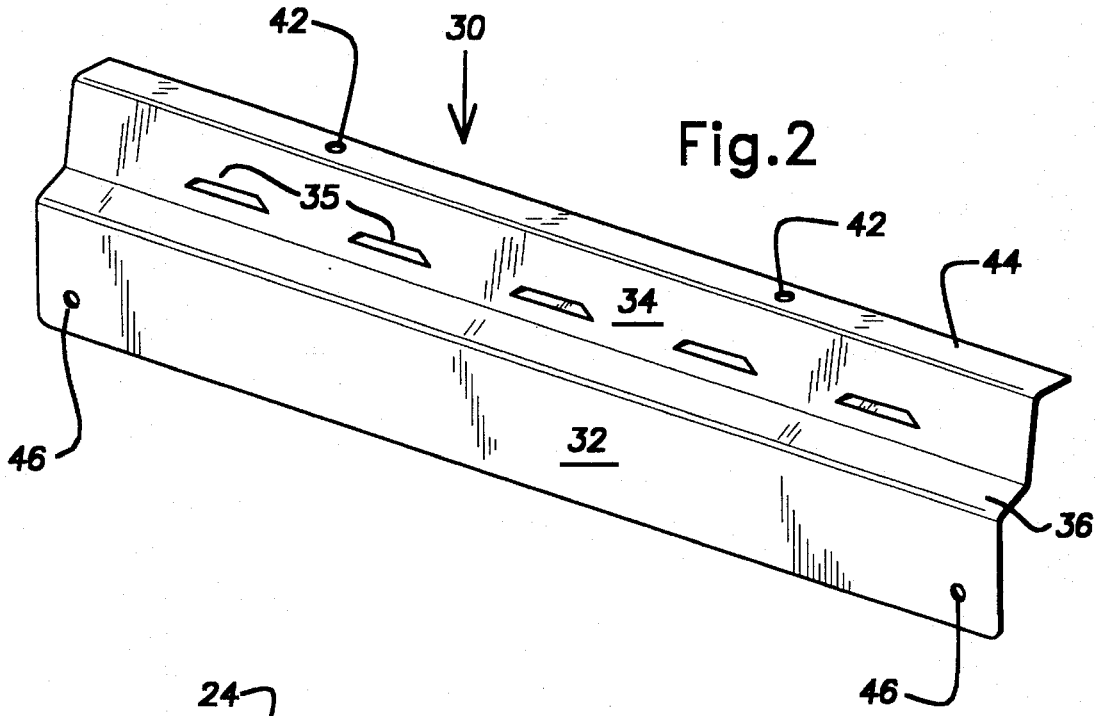
FIG. 2 is an isometric view of the combined toe-plate-and-access-panel member on an enlarged scale and from a different angle.

Shown in FIG. 1 is a dishwasher 10 which is illustrative of the general type referred to in the above background, but which also embodies the present invention.

The washer 10 has a unitary molded plastic tub 12 supported by a front or door frame 14 and rear supports or frame members 16. The tub may be injection-molded in one piece from suitable material, for example, mineral-filled polypropylene. In the particular construction shown, the rear frame members include forward extensions 18 which are fastened to legs or brackets 20. The brackets 20 support the door frame 14 and are also associated with hinge pins 22 (FIG. 3) of the dishwasher door 24. The frame may be reinforced by a cross brace or plate 21 which is fastened at each end to one of the brackets 20. The cross plate may be formed with a connector box mount and with openings for guiding or receiving other elements of the dishwasher system, as shown in FIG. 1.

The frame members support the tub 12 above the floor or other mounting surface on which the dishwasher rests, to provide an under-tub space 26 (FIG. 3) in which water lines, cables, drains and drain valves, connector boxes and the like may be located.

As is typical of dishwashers of the general type to which the invention relates, the bottom of the dishwasher door is spaced above the floor or other mounting surface to provide a toespace 27 at the front of the washer below the door. As previously mentioned, provision of a toespace improves the aesthetics of the washer and contributes the comfort of users or other persons when loading or unloading the dishwasher or working on the counter under which the dishwasher is located.

Figure 3:
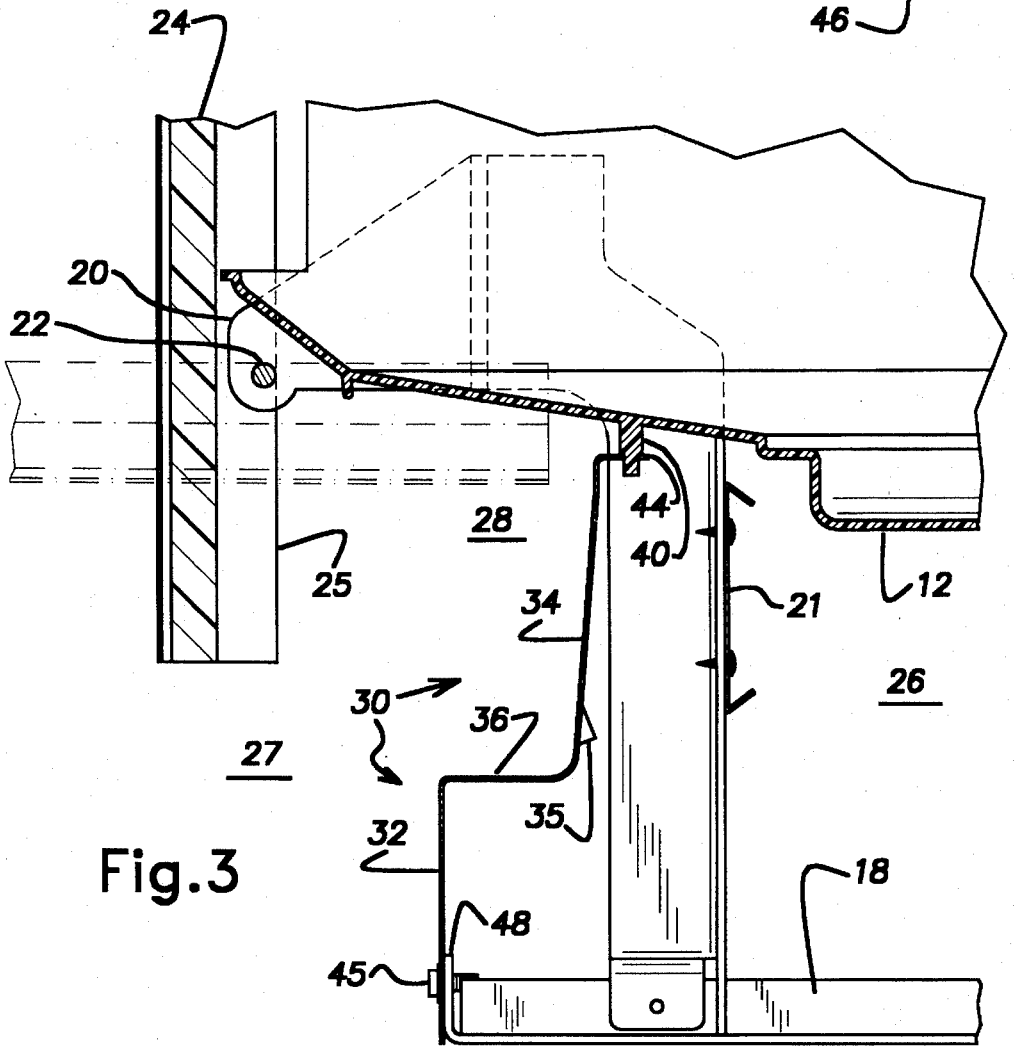
FIG. 3 is a sectional side elevation view, on a still larger scale, of the front lower portion of the dishwasher, viewed from the right of the dishwasher as seen in FIG. 1, and showing the combined toeplate-and-access-panel member installed; the dishwasher door is shown in closed position, and the open position of the door is illustrated in phantom.

As is also typical of dishwashers of the general type to which the invention relates, the dishwasher door opens around a hinge line spaced slightly above the door bottom, as can be seen in FIG. 3 from the relationship of the hinge pins 22 to the bottom of the closed door. This causes the bottom of the door to hinge inwardly and upwardly, as it is closed, into a recess space 28 below the front part of the tub 12. Side flanges 25 (FIG. 3) of the door are located laterally outside the tub 12, and the tub does not interfere with their closing motion even though portions of them end up above the tub floor when, as seen in phantom in FIG. 3, the door is fully open.

As previously mentioned, the provision of a toeplate behind a toespace serves to define the rearward limit of the toespace. The toeplate engages the toe of a user's shoe and thereby prevents the user from inadvertently stepping inward to damage any elements that may be located in the under-tub space and immediately behind the toespace. Thus in the illustrated dishwasher, a toeplate 32 is provided defining the rearward limit of the toespace 27.

In closing off the under-tub space from the toespace, the toeplate also gives the dishwasher a dressed and finished appearance and limits the ingress of soil and dust into the under-tub space. For similar reasons, it is desirable to also close off the under-tub space from the recess space 28. This may be done by provision of an access panel 34. The access panel 34 and toeplate 32 may be joined by a middle panel 36. As is apparent in the drawings, the toeplate 32 and access panel 34 constitute relatively vertical panels joined by the relatively horizontal middle panel 36. The three panels together provide a combined toeplate-and-access-panel member generally indicated by the reference number 30. The access panel 34 may be provided with pierced ventilation louvers 35.

Since the toeplate must provide firm resistance to pressure or impact by a shoe tip or the like, combined toeplate-and-access-panel members of this general type must have both their top and bottom edges firmly anchored to the dishwasher structure. Such members have heretofore been anchored with threaded fasteners at both their tops and bottoms to frame members such as brackets or the like. The fastening (and unfastening) of the bottom edge is relatively easy because of the easy access thereto via the toespace and the generous clearance under the bottom of the dishwasher door. However, access to the top edge is limited, and it is difficult and awkward to emplace and tighten down (or back off on) fasteners fixing the top edge to frame members. In sum, toeplate and access-panel members have been difficult to install, remove, or reinstall because of the difficulty of positioning and manipulating threaded fasteners at the hard-to-reach top edge of the member.

The present invention provides cooperating projections 40 and receptors 42 associated respective with the tub bottom and the top edge of the combined toeplate-and-access-panel member. The projections 40 are aligned transverse to the tub, and in the illustrated embodiment comprise a pair of downward projections in the form of bosses. The receptors are positioned at or near the top edge of the combined member 30, and in the illustrated embodiment comprise receptor holes 42 formed in a relatively horizontal flange 44 extending rearward along the top side of the member 30.

Screws or other fasteners anchor the bottom edge of the member 30 to the frame. In the illustrated embodiment, the screws 45 pass through screw holes 46 to anchor the lower edge of the member 30 to the upturned tabs 48 formed at the forward ends of the forwardly extending frame members 18.

Installation or removal of the combined member 30 is very easy to accomplished, since only the fasteners 45 need be positioned and tightened down, or removed. When installing in the field, the receptor holes 42 at the top edge of the member 30 are easily placed over the shouldered projections 40 by manipulation of member 30 while grasping its bottom edge. Then the bottom edge of the member 30 is moved rearward until it contacts the tabs 48, at which point the member 30 is held in proper vertical position by the mounting surface or floor on which the dishwasher rests. During this rearward motion, the cooperating projections 40 and receptors 42 act as hinges to accommodate and define the swinging of the bottom of the member 30 against the tabs 48. It is then a very simple matter to position, start and tighten down the fasteners 45 to complete the installation.

It should be evident that this disclosure is by way of example and that various changes may be made by adding, modifying or eliminating details without departing from the fair scope of the invention or the teaching contained in this disclosure. For example, the projections 40 in the form of shouldered bosses may be replaced by aligned laterally extending ribs projecting down vertically from the bottom of the tub, and the receptor holes replaced by rib-engaging spring clips pierced from the access panel 34 adjacent its top edge and adapted to slip over and engage the ribs. The invention is therefore not limited to particular details of the disclosure except to the extent that the following claims are necessarily so limited.

What is claimed is:

1. In a dishwasher supported on a floor or other mounting surface and having a box-like tub, said tub having a bottom wall and an open front, a frame supporting said tub above a mounting surface to provide an under-tub space between said bottom wall of said tub and said mounting surface, a door for said open front of said tub, said door opening around a hinge line spaced above a bottom of said door whereby the bottom of the door hinges inwardly and upwardly into a recess space below the tub when the door is opened outwardly, and a detachable combined toeplate-and-access-panel member covering said under-tub space both behind said recess space and below said door, said member having lower and upper edges, the lower edge of said member being adjacent said mounting surface, the upper edge of said member being adjacent the bottom of said tub, a pair of downward projections fixed to the bottom of the tub and aligned transverse to the tub and generally parallel to said hinge line, said upper edge of said member having associated therewith a pair of receptors in register with and engagable over said projections, said lower edge of said member having a pair of fasteners fixing it to said supporting frame, said fasteners being the only fasteners requiring removal and installation in the course of removing and reinstalling said member, and being below the bottom of said door and readily accessible from the front of the dishwasher.

2. The device of claim 1 wherein, upon placement of said receptors over said projections, said projections and receptors are adapted to cooperate as hinging elements for guided swinging of the bottom of said combined toeplate-and-access-panel member into installed position.

3. The device of claim 2, in which said combined toeplate-and-access-panel member is supported by said mounting surface substantially in said member's installed position prior to placement and tightening of said fasteners.

4. The device of claim 1 in which said downward projections are in the form of shouldered bosses depending from said tub bottom and formed integrally therewith, and said receptors are in the form of holes formed in a flange extending rearward along the upper edge of said member.

5. The device of claim 4, wherein said flange rests against shoulders of said bosses upon placement of the receptor holes over said bosses in the installed condition of said combined toeplate-and-access-panel member.

6. The device of claim 1 wherein said tub includes a bottom wall, a top wall, two side walls, and a back wall.

7. The device of claim 1 wherein said fasteners are screws.

8. The device of claim 1 wherein said combined toeplate-and-access-panel member comprises a lower forward panel and a upper rearward panel each of which is relatively vertical, and a middle panel which is relatively horizontal and joins the upper and lower panels, said panels being formed as a single piece of sheet material.

9. In a dishwasher supported on a floor or other mounting surface and having a box-like tub, said tub having a bottom wall, a top wall, two side walls, a back wall and an open front, a metal frame supporting said tub above a mounting surface to provide an under-tub space between said bottom wall of said tub and said mounting surface, a door for said open front of said tub, said door opening around a hinge line spaced slightly above the bottom of the door whereby the bottom of the door hinges inwardly and upwardly into a recess space below the tub when the door is opened outwardly, and a detachable combined toeplate-and-access-panel member covering a front of said under-tub space both behind said recess space and below said door, said member comprising a lower forward panel and an upper rearward panel each of which is relatively vertical, and a middle panel which is relatively horizontal and joins the upper and lower panels, said panels being formed as a single piece of sheet material, said lower panel having a lower edge, said lower edge being adjacent said mounting surface, said upper panel having an upper edge, said upper edge being adjacent the bottom of said tub, a pair of downward projections fixed to the bottom of the tub and aligned transverse to the tub and generally parallel to said hinge line, said upper edge of said upper panel having associated therewith a pair of receptors in register with and engagable over said projections, said lower panel having a pair of threaded fasteners fixing it to said metal frame, said fasteners being the only fasteners requiring unthreading and threading in the course of removing and reinstalling said member, and being well below the bottom of said door and readily accessible from the front of the dishwasher.

* * * * *